US005669792A

United States Patent [19]

Naka et al.

[11] Patent Number: 5,669,792

[45] Date of Patent: Sep. 23, 1997

[54] ELECTRICAL CONNECTOR

[75] Inventors: Shigeru Naka, Kawasaki; Satoshi Suzuki, Inagi; Akihito Ono, Machida, all of Japan

[73] Assignee: The Whitaker Corporation, Wilmington, Del.

[21] Appl. No.: 664,928

[22] Filed: Jun. 11, 1996

Related U.S. Application Data

[63] Continuation of Ser. No. 305,106, Sep. 13, 1994, abandoned.

[30] Foreign Application Priority Data

Oct. 29, 1993 [JP] Japan ..... 5-062986
Dec. 29, 1993 [JP] Japan ..... 5-075068

[51] Int. Cl.[6] ..... H01R 13/05

[52] U.S. Cl. ..... 439/825

[58] Field of Search ..... 439/741, 744–746, 439/825, 842, 843, 851–856, 861, 862, 751

[56] References Cited

U.S. PATENT DOCUMENTS

| | | | |
|---|---|---|---|
| 4,367,006 | 1/1983 | Rehbogen, Jr. et al. | 439/636 |
| 4,676,579 | 6/1987 | Ting | 439/825 |
| 4,717,354 | 1/1988 | McCleerey | 439/751 |
| 4,790,764 | 12/1988 | Kawaguchi et al. | 439/825 |
| 4,825,541 | 5/1989 | Czeschka et al. | 439/825 |
| 4,908,942 | 3/1990 | Tong et al. | 439/751 |
| 4,909,754 | 3/1990 | Paradis | 439/751 |
| 4,948,382 | 8/1990 | Marpoe, Jr. et al. | 439/406 |
| 5,046,972 | 9/1991 | Pass | 439/751 |

FOREIGN PATENT DOCUMENTS

| | | | |
|---|---|---|---|
| 2716393 | 10/1978 | Germany | 439/751 |

*Primary Examiner*—J. J. Swann

[57] ABSTRACT

An electrical connector includes an electrical contact 1, 1' secured in a housing 2. A wire-connecting section 4 connects the contact to an electrical wire and a solder tine contact section 3, 3' extends through an opening 12 in the housing. A contact test plate 8 is located on the contact section 3 within the opening 12 for engagement by a test contact to perform a conductivity test. Posts 9 and protuberances 23 are located at the base of the contact section 3 to secure the contact 1,1' in the housing 2. Section 20 of the plates 18, 19 are arcuate shaped to strenghten the contact section 3'.

20 Claims, 2 Drawing Sheets

ELECTRICAL CONNECTOR

This application is a Continuation of application Ser. No. 08/305,106 filed Sep. 13, 1994, now abandoned.

FIELD OF THE INVENTION

This invention relates to an electrical connector used as a circuit board electrical connector which is typically inserted in the openings of circuit boards.

BACKGROUND OF THE INVENTION

One typical example of a circuit board electrical contact presently on the market is a unitized two-section structure consisting of a wire-connecting section and a contact section which is inserted into the openings of a circuit board and which is solder connected thereto. This type of electrical contact, with its two-section structure is structured so that the tip of the long tine of the contact section is bent into a V-shape, with the short tine wrapped by the long tine.

The conventional electrical connector consists of several of this type of contacts accommodated within the same housing. This electrical connector is usually used in a harness configuration, and the harness is typically manufactured with automatic manufacturing equipment.

In order to raise yields in the manufacture of harnesses, inspection procedures are essential to determine whether the electrical connection between the contacts and wires are good or not.

However, in conventional circuit board electrical connectors having a solder tine contact section, it is structurally impossible to do conductivity inspections with a receptacle-type electrical test contact.

Also, the solder tine contact sections of conventional electrical contacts are weak and may bend when the connectors containing the contacts are mounted onto circuit boards.

Therefore, the goal of this invention is to improve the configuration of the circuit board electrical contacts and the housing in order to make possible the use of the same receptacle-type electrical contact test apparatus, in other words, using the same test contacts for inspection purposes.

Another goal of this invention is to strengthen the tine members of the solder tine section of the electrical contact.

SUMMARY OF THE INVENTION

This invention is an electrical connector having electrical contacts and housing for connecting electrical wires to the wire-connecting sections for the support of the wires which electrically engage a pair of plate-shaped connecting members. This electrical connector is characterized by having the above-mentioned pair of plate-shaped connecting members extending from the insulated end to the other end, and access from the outside of the housing to the connecting sections by means of an opening.

The circuit board electrical contacts used by this invention are equipped with wire-connecting sections which make electrical contact with and supports the wires, two-tine solder tine contact sections which are inserted in holes of a circuit board, and contact test plates which are located at the base of the solder tine contact section perpendicular to the solder tine contact sections.

The contact test plate used by the electrical connector of this invention makes contact with the test contact tips brought close from the electrical contact circuit board engaging-side, and it is situated approximately perpendicular to the solder tine sections in order to make the needed electrical contact with the engaging unit it faces. As required, a pair of posts are provided at the rear of the contact test plate. At least one of these posts makes contact with the contact test plate, providing a supporting surface to support contact test plate. The supporting surface prevents sagging of the contact test plate when test contacts make contact with the contact test plate. Moreover, the tops of the posts are sloped, ensuring correct positioning when the electrical contacts are inserted into the housing, as well as preventing moving when affixing the electric contacts onto a circuit board. Furthermore, the housing is designed with the contact test plate being exposed so that the test contacts can be inserted thereagainst.

The tine members of the solder tine section are curved in cross section to strengthen the solder tine section.

An electrical connector comprises a dielectric housing, an electrical contact disposed in the housing and having a wire-connecting section and a contact section in the form of plate members having their free ends interengaged extending through an opening in the housing and outwardly from a surface of the housing, posts are located on the plate members engaging with a wall of the opening securing the contact in the housing.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
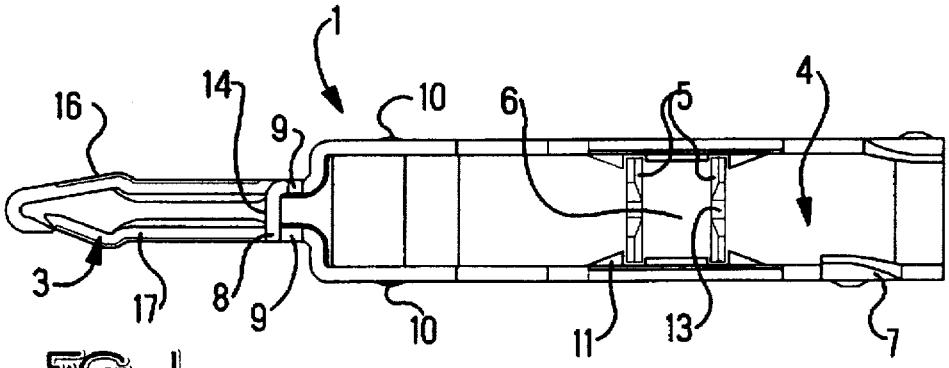
FIG. 1 is a top plan view of an electrical contact.
Figure 2:
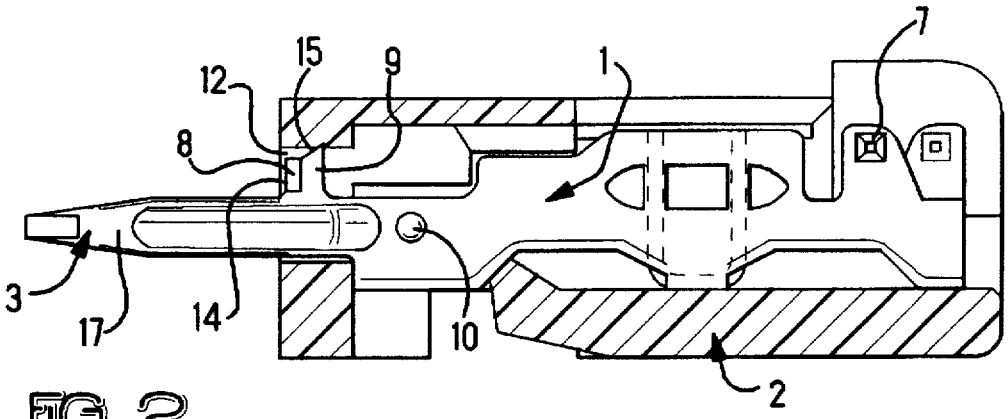
FIG. 2 is a cross-sectional view taken along line 2—2 of the connector of FIG. 3 showing a side view of the contact of FIG. 1 secured in a contact-receiving passage of a housing.

FIGS. 1 and 2 show an example of the electrical contact used in this invention. As indicated in FIG. 1, the electrical contact 1 includes a wire-connecting section 4 which terminates an electrical wire and the solder tine contact section 3 which is inserted into the hole of a circuit board to make a soldered connection therewith. The wire-connecting section 4 is furnished with a wire-connecting unit 6 which makes electrical connection with the conductor inside the wire, and a wire support unit 7 which supports the wire. Wire-connecting unit 6 is comprised of two pressure connecting plates 5. The two pressure connecting plates 5 are approximately parallel, and each pressure connecting plate has a pressure connecting slot 13. Each pressure connecting plate 5 is supported by pressure connecting plate supports 11, which protrude inwardly from the sides of the electrical contact 1. Furthermore, the wire support unit 7 consists of bendable metal.

The solder tine contact section 3, which is inserted into the hole of the circuit board, consists also of two plates 16, 17 of bendable metal, so that the end of the long plate 16 can wrap onto the end of the short plate 17.

A contact test plate 8 is located near the base of the solder tine contact section 3. The contact test plate 8 is bent on its side so that it stands approximately perpendicular to the lengthwise direction of the solder tine contact section 3. Electrical contact tests are done to confirm conductivity by touching a test contact to a test surface 14 on the contact test plate 8. As shown in FIG. 2, when electrical contact 1 is accommodated in housing 2, the test surface 14 of contact test plate 8 is correctly situated in the housing 2 for the test contact to engage it.

Posts 9 are located at the rear of the contact test plate 8. The top of posts 9 have a sloped surface 15. When the sloped surfaces 15 are inserted into the dielectric housing 2 of the electrical connector 1, they guide the electrical contact 1. Moreover, when the electrical contact 1 is secured in the housing 2, the top of the sloped surfaces 15 exert pressure on the top wall of the housing, preventing movement of the solder tine contact section 3. Also bosses 10, which engage the housing wall inner surfaces, are provided on the electrical contact 1 in order to minimize mispositioning and to prevent lateral movement of the electrical contact 1.

The wire-connecting section 4 is designed to terminate an insulated wire. The insulated wire has an electrical pressure connection with the two pressure connection slots 13 of the wire-connecting unit 6, and the insulated portion of the wire is held and supported by the wire support unit 7, providing stress relief.

Figure 3:
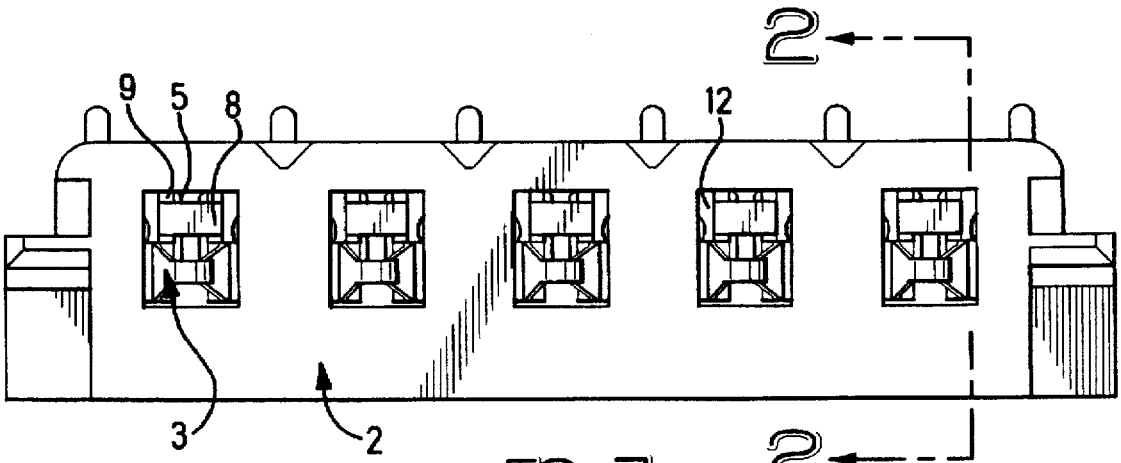
FIG. 3 is a front elevational view of the connector.

FIG. 3 shows a front view of the electrical contact 1 inserted in the housing 2, that was shown in FIG. 2. The solder tine contact section 3 extends through the opening 12 in the housing, and is moreover open to the test surface 14 of the contact test plate 8. The test contact will pass through the housing opening, reaching the inside of the housing 2, and make contact with the contact test plate 8. The contact test plate 8 is positioned by posts 9 at the rear of the contact section 3.

As described above, the testing structure of the electrical connector of this invention can be used for purposes other than that of circuit board electrical contacts. Furthermore, the connector can be used by manufacturers in a variety of configurations without departing from the essence of the invention.

For example, a possible reconfiguration of this connector might be an electrical contact which uses the test contact area in the form of paired contact sections consisting of individually-paired metal plates with solder tine areas having flexibility and being extended inward. In this case, the test contacts would be flexibly inserted between the metal plates and then the electrical conductivity testing would be performed.

Through the use of this electrical connector, it is possible to use conventional receptacle-type electrical contacts which correspond as well to test pins for the testing of electrical connections. In the manufacture of harnesses, including connectors which have receptacle-type electrical contacts, inspection and testing can be performed quickly and effectively. There is, moreover, no need to change the test pins, therefore offering as well economic advantages.

Due to the configuration of this electrical connector, it is possible to prevent looseness in the area of the electrical contact engaging faces when positioning the contacts in the housing.

Figure 4:
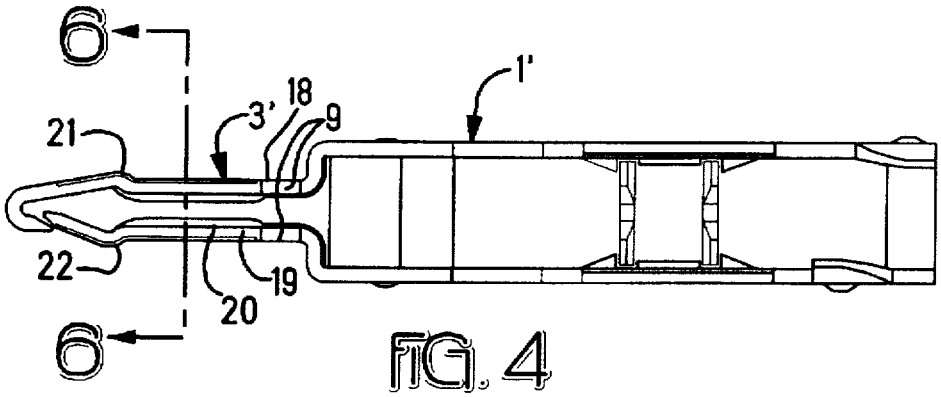
FIG. 4 is a view similar to FIG. 1 showing an alternative embodiment.
Figure 5:
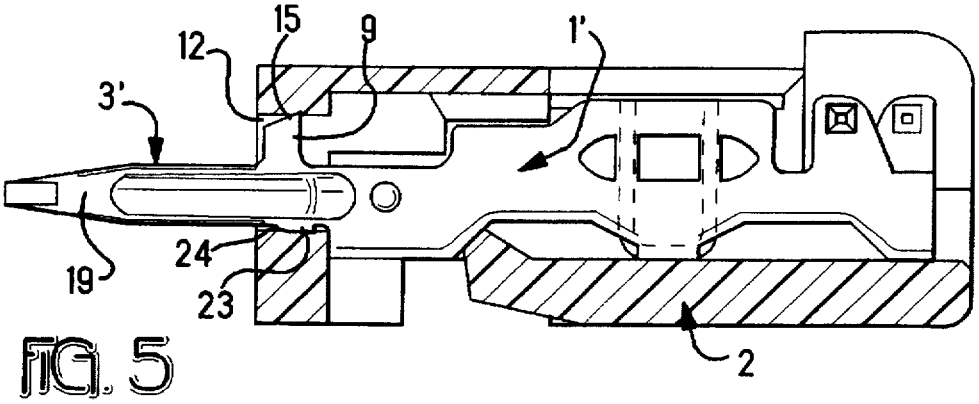
FIG. 5 is a view similar to FIG. 2 showing the contact of FIG. 4 in the contact-receiving passage of the housing.
Figure 6:
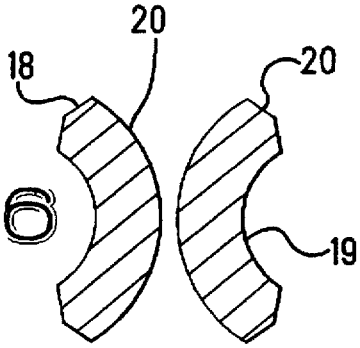
FIG. 6 is a cross-sectional view taken along line 6—6 of FIG. 4.

FIGS. 4–6 show an embodiment of electrical contact 1' which is essentially the same as electrical contact 1 except for the following differences. Solder tine contact section 3' has two plates 18, 19 formed the same as plates 16, 17 except that the sections 20 of plates 18, 19 from posts 9 to projections 21, 22 are arcuate shaped thereby strengthening plates 18, 19 and contact section 3'. Protuberances 23 are located on plates 18, 19 opposite posts 9 and they have sloping surfaces 24 similar to sloping surfaces 15 on posts 9 to enable posts 9 and protuberances 23 to be guided into opening 12 of housing 2 with posts 9 and protuberances 23 securing contact 1' in housing 2. A test pin can engage posts 9 to perform conductivity tests between the contact 1' and the wire terminated thereto.

Figure 7:
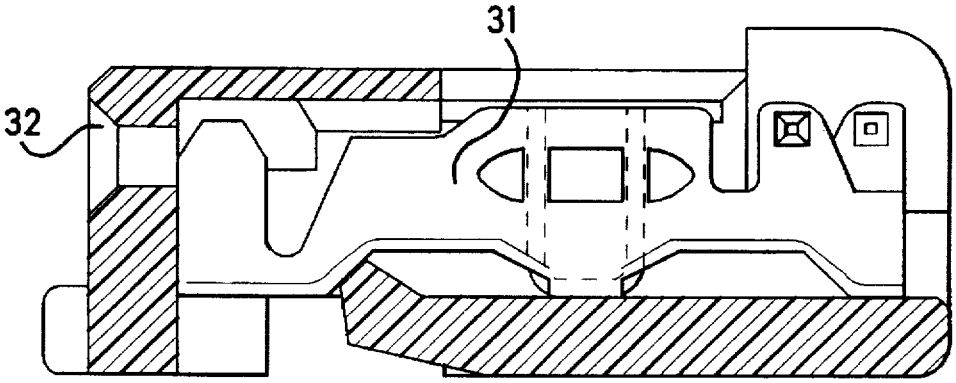
FIG. 7 PRIOR ART
FIG. 7 is a cross-sectional view of a conventional electrical connector.

FIG. 7 shows a conventional electrical connector including an electrical contact 31 secured in a housing having a hole 32 through which a contact pin extends for electrical connection with a receptacle contact section of the contact 31.

We claim:

1. An electrical connector comprises a dielectric housing, and an electrical contact disposed in the housing having a wire-connecting section and a contact section in the form of plate members having interengaged free ends extending through an opening in the housing and outwardly from a surface of the housing, characterized in that said free ends interengage at the outermost tips thereof, at least one of said interengaging free ends is generally J-shaped and posts are located on said plate members engaging with a wall of said opening securing the contact in the housing.

2. The electrical connector as claimed in claim 1, wherein a contact test plate is located on the contact section adjacent said posts.

3. The electrical connector of claim 1, wherein the top ends of said posts are formed in tapered surfaces to engage the inner wall of said opening.

4. An electrical connector comprises a dielectric housing, and an electrical contact disposed in the housing having a wire-connecting section and a contact section in the form of plate members having interengaged free ends extending through an opening in the housing and outwardly from a surface of the housing, characterized in that at least one of said interengaging free ends is generally J-shaped, posts are located on said plate members engaging with a wall of said opening securing the contact in the housing, and protuberances are located on said plate members opposite said posts engaging the wall of said opening.

5. The electrical connector as claimed in claim 4, wherein a contact test plate is located on the contact section adjacent said posts.

6. The electrical connector as claimed in claim 5, wherein said contact test plate is disposed in said opening.

7. The electrical connector of claim 4, wherein the top ends of said posts are formed in tapered surfaces to engage the inner wall of said opening.

8. The electrical connector as claimed in claim 5, wherein said plate members have an arcuate section to strengthen said plate members.

9. The electrical connector as claimed in claim 4, wherein said plate members have an arcuate section to strengthen said plate members.

10. The electrical connector as claimed in claim 1, wherein said plate members have an arcuate section to strengthen said plate members.

11. An electrical connector, comprising:

a dielectric housing having a contact-receiving passageway and an opening;

an electrical contact having a wire-connecting section disposed in said contact-receiving passageway and a contact section extending through said opening and outwardly from a surface of said housing; said contact section being in the form of parallel plate members having interengaged free ends, said free ends interengaging at the outermost tide thereof; and posts on said plate members engaging a wall of said opening securing the electrical contact in the housing.

12. The electrical connector as claimed in claim 11, wherein a contact test pate is located on the contact section adjacent said posts.

13. The electrical connector of claim 11, wherein the top ends of said posts are formed in tapered surfaces to engage the inner wall of said opening.

14. An electrical connector, comprising:

a dielectric housing having a contact-receiving passageway and an opening;

an electrical contact having a wire-connecting section disposed in said contact-receiving passageway and a contact section extending through said opening and outwardly from a surface of said housing; said contact section being in the form of parallel plate members having interengaged free ends;

posts on said plate members engage a wall of said opening securing the electrical contact in the housing; and protuberances are located on said plate members opposite said posts engaging the wall of said opening.

15. The electrical connector as claimed in claim 14, wherein a contact test plate is located on the contact section adjacent said posts.

16. The electrical connector as claimed in claim 15, wherein said contact test plate is disposed in said opening.

17. The electrical connector of claim 14, wherein the top ends of said posts are formed in tapered surfaces to engage the inner wall of said opening.

18. The electrical connector as claimed in claim 15, wherein said plate members have an arcuate section to strengthen said plate members.

19. The electrical connector as claimed in claim 4, wherein said plate members have an arcuate section to strengthen said plate members.

20. The electrical connector as claimed in claim 11, wherein said plate members have an arcuate section to strengthen said plate members.

* * * * *